US009894982B1

(12) United States Patent
Huang

(10) Patent No.: US 9,894,982 B1
(45) Date of Patent: Feb. 20, 2018

(54) COSMETIC APPLICATOR

(71) Applicant: Wei Chin Huang, Guangdong (CN)

(72) Inventor: Wei Chin Huang, Guangdong (CN)

( * ) Notice: Subject to any disclaimer, the term of this patent is extended or adjusted under 35 U.S.C. 154(b) by 0 days.

(21) Appl. No.: 15/364,353

(22) Filed: Nov. 30, 2016

(51) Int. Cl.

| | |
|---|---|
| ***B43K 5/18*** | (2006.01) |
| ***A47L 13/30*** | (2006.01) |
| ***B43M 11/06*** | (2006.01) |
| ***A45D 40/26*** | (2006.01) |

(52) U.S. Cl.
CPC ..... *A45D 40/26* (2013.01); *A45D 2200/1009* (2013.01); *A45D 2200/1018* (2013.01)

(58) Field of Classification Search
CPC ..... A45D 40/26; A45D 2200/1018; A45D 2200/1009
USPC ..... 401/264, 265
See application file for complete search history.

(56) References Cited

U.S. PATENT DOCUMENTS

| | | | | |
|---|---|---|---|---|
| 6,688,795 | B1 * | 2/2004 | Jacob | A45D 34/04 401/202 |
| 8,821,059 | B2 * | 9/2014 | Sasaki | A45D 33/02 401/132 |
| 9,763,509 | B1 * | 9/2017 | Dutton | A45D 34/04 |

* cited by examiner

*Primary Examiner* — Jennifer C Chiang

(57) ABSTRACT

A cosmetic applicator includes a dispensing member including a space, perforations on one surface, an opening on the other opposite surface, and an externally extending rim formed around the opening; a sponge in the space; a central shaft seat including an annular base in the opening, an annular lip formed on the base and supported by the rim, and a hollow cylinder having an axial channel; first and second half housings each including a curved trough adjacent to a bottom; a check valve in the channel; and a cap including a hollow stem partially disposed in the channel. The lip is fastened in the troughs of the first and second half housings. The first and second half housings are complementarily secured together. The central shaft seat is fastened in the first and second half housings.

10 Claims, 5 Drawing Sheets

COSMETIC APPLICATOR

BACKGROUND OF THE INVENTION

1. Field of the Invention

The invention relates to cosmetic applicators and more particularly to a cosmetic applicator including a hollow cylinder for allowing lotion to fill in a sponge of a dispensing member, and a check valve in the cylinder to prevent the lotion from flowing back, the dispensing member having a plurality of perforations for applying the lotion to the body of an individual in which the hand of the individual may not contact the sticky lotion in the application operation.

2. Description of Related Art

Conventionally, an individual may squeeze some lotion out of a flexible cosmetic container on one hand, apply the same on the body with the other hand, and uniformly rub the body with the lotion by using finger(s).

However, the appropriate volume of the squeezed out lotion can be only controlled by experience. It is often that excess lotion is squeezed out to cause waste or less lotion is squeezed out, i.e., multiple squeezing operations being required.

Thus, the need for improvement still exists.

SUMMARY OF THE INVENTION

It is therefore one object of the invention to provide a cosmetic applicator comprising a dispensing member including a space, a plurality of perforations on a first surface, an opening on a second surface communicating with the space, the second surface being opposite to the first surface, and an externally extending rim formed around the opening; a sponge disposed in the space; a central shaft seat including an annular base disposed in the opening, an annular lip formed on the base and supported by the rim, and a hollow cylinder spaced from the lip, the cylinder having an axial channel extending from a first end to a second end adjacent to the base; a first half housing including a curved trough adjacent to a bottom; a second half housing including a curved trough adjacent to a bottom wherein the lip is fastened in the troughs of the first and second half housings, the first and second half housings complementarily secured together, and the central shaft seat is fastened in the first and second half housings; a check valve disposed in the channel; and a cap including a hollow stem partially disposed in the channel. The hollow stem is fastened on an extension of the check valve and the hollow stem is partially disposed in the channel.

The invention has the following advantages and benefits in comparison with the conventional art: lotion can be filled in the sponge via the hollow cylinder. The lotion may permeate in the sponge. In use, an individual may repeatedly press the perforations of the dispensing member onto the body of the individual to apply the lotion thereonto for rubbing purpose. The hand of the individual may not contact the sticky lotion in the application operation, thereby solving the conventional problem of squeezing lotion out of a flexible cosmetic container with one hand, applying same on the body with the other hand, and uniformly rubbing the body with the lotion by using finger(s). The base of the central shaft seat is disposed in the opening of the dispensing member. The lip is disposed on the base. The rim of the dispensing member is disposed in the troughs of the first and second half housings. Thus, the dispensing member, the central shaft seat and the first and second half housings are fastened together. The lotion in the sponge is prevented from a joining portion of the dispensing member and the central shaft seat. The dispensing member is made of thermoplastic material. The dispensing member may return to its original shape after repeatedly pressing same in the application operation.

The above and other objects, features and advantages of the invention will become apparent from the following detailed description taken with the accompanying drawings.

DETAILED DESCRIPTION OF THE INVENTION

Figure 1:
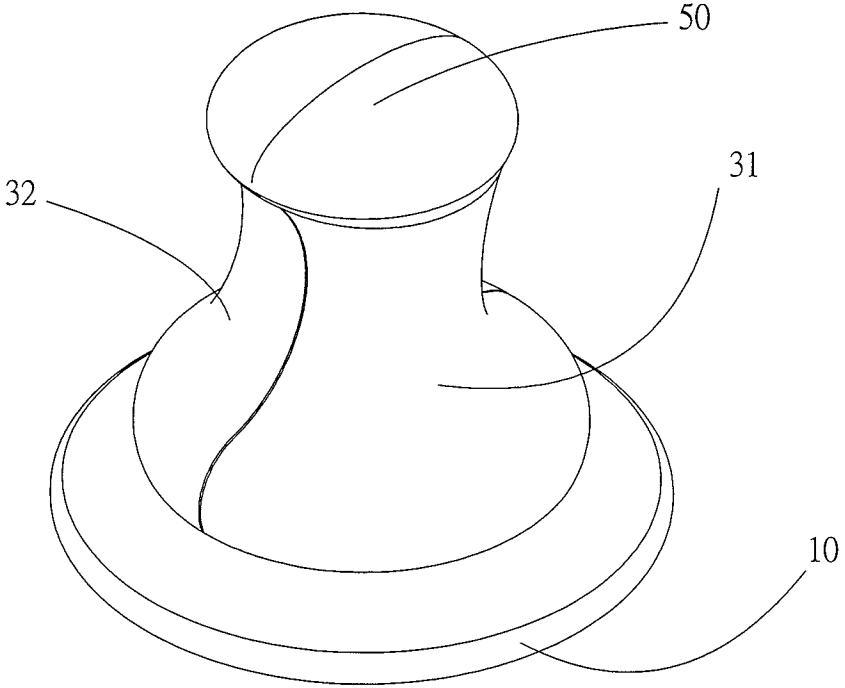
FIG. 1 is a perspective view of a cosmetic applicator according to the invention.

Referring to FIGS. 1 to 5, a cosmetic applicator in accordance with the invention comprises the following components as discussed in detail below.

A dispensing member 10 includes a plurality of perforations 16 on one surface, an internal space 14, an opening 12 on the other surface communicating with the space 14, and an externally extending rim 11 formed around the opening 12, the bottom of the rim 11 being spaced from the other surface.

A sponge 18 is provided in the space 14.

A central shaft seat 20 includes an annular base 26 disposed in the opening 12, an annular lip 24 formed on the top of the base 26 and supported by the rim 11, and a central hollow cylinder 22 spaced from the lip 24 and having a neck 222 on the top and a channel 221 extending from the neck 222 to the bottom adjacent to the base 26.

Preferably, the cylinder 22, the lip 24, and the base 26 are formed integrally.

A first half housing 31 is a curved member and has a smaller intermediate portion and two larger upper and lower portions in which the lower portion is larger than the upper portion. The first half housing 31 includes a positioning member 34 formed on an inner surface, a curved member 38 on an edge of the positioning member 34, a protrusion 39 above the positioning member 34, a curved trough 36 adjacent to the bottom, and two recesses 312 along two opposite ends of the surface respectively. A second half housing 32 is complementary to the first half housing 31. In detail, the second half housing 32 is a curved member and has a smaller intermediate portion and two larger upper and lower portions in which the lower portion is larger than the upper portion. The second half housing 32 includes a positioning member 34 formed on an inner surface, a curved member 38 on an edge of the positioning member 34, a protrusion 39 above the positioning member 34, a curved trough 36 adjacent to the bottom, and two projections 322 along two opposite ends of the surface respectively. After being assembled, the projections 322 are fitted in the recesses 312 to fasten the first and second half housings 31 and 32 together. Further, the rim 11 is fastened in the troughs 36. Furthermore, the neck 222 is fastened by the curved members 38. Additionally, the lip 24 is fastened by the tops of the troughs 36.

A check valve 40 is provided in the channel 221 and includes a smaller lower end 401 disposed in a smaller lower end of the channel 221 and being in close proximity to the base 26, and an extension 402 on a top portion thereof.

In one embodiment, a cap 50 includes an annular latch 59 on the bottom edge, the latch 59 being secured to the protrusions 39 to fasten the cap 50 and the first and second half housings 31 and 32 together, and a hollow stem 52 on a central portion of the bottom, the hollow stem 52 disposed in an upper half portion of the channel 221 and fastened on the extension 402 of the check valve. The hollow stem 52 together with the extension 402 and the check valve 40 are disposed in the channel 221. That is, the hollow stem 52 is disposed between the extension 402 and the check valve 40. Preferably, the neck 222 has an outer diameter less than that of the cylinder 22.

Preferably, the first and second half housing 31 and 32 are formed integrally. More preferably, the first and second half housing 31 and 32 are formed integrally by means of ultrasonic welding.

Preferably, the central shaft seat 20 and the first and second half housing 31 and 32 are formed integrally.

Preferably, the check valve 40 and the cap 50 are formed integrally.

As shown in FIGS. 2, 3, 3A and 3B specifically, an outer diameter of the lip 24 is greater than that of the base 26. An outer diameter of the base 26 is less than a diameter of the opening 12. Thus, the base 26 can be fitted in the opening 12 when the central shaft seat 20 and the dispensing member 10 are assembled. The bottom of the lip 24 is disposed upon the rim 11. The bottom of the hollow stem 52 is disposed on a shoulder between the extension 402 and the check valve 40 so that the inner annular surface of the hollow stem 52 abuts against the outer annular surface of the extension 402.

Figures 2, 2A:
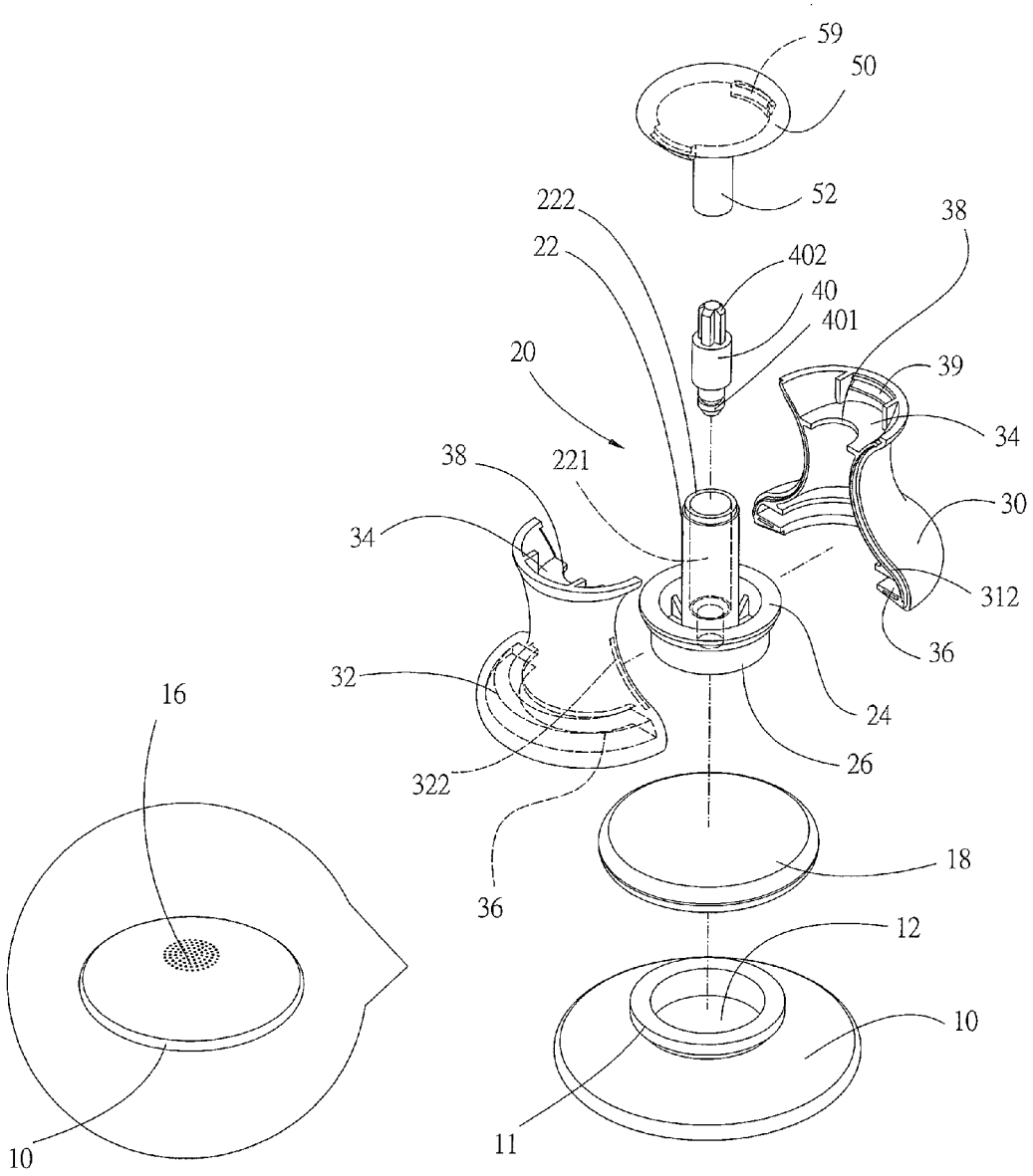
FIG. 2 is an exploded view of the cosmetic applicator.
FIG. 2A is a perspective view of the dispensing member showing its perforations.
Figure 3A:
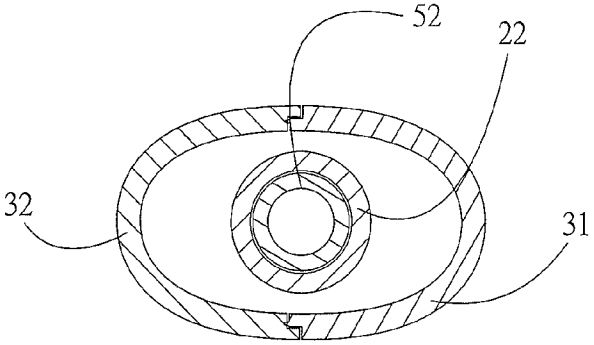
FIG. 3A is a sectional view taken along line A-A of FIG. 3.
Figure 3B:
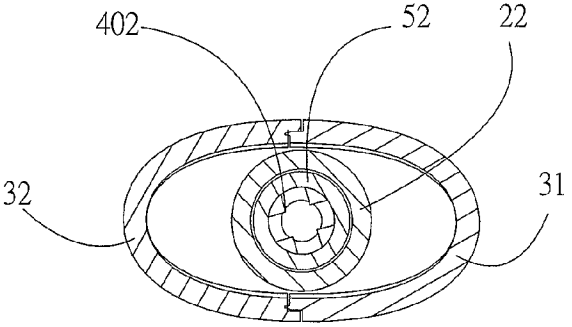
FIG. 3B is a sectional view taken along line B-B of FIG. 3.
Figure 3:
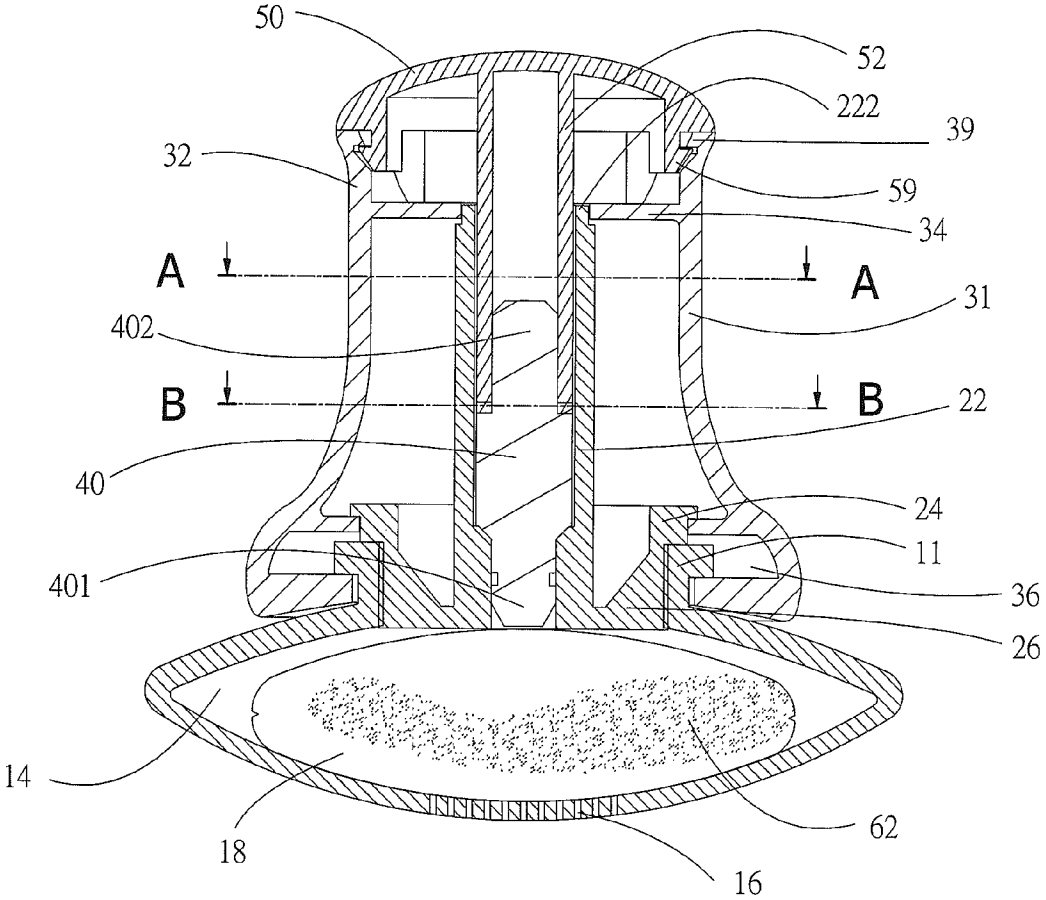
FIG. 3 is a longitudinal sectional view of the cosmetic applicator.
Figure 4:
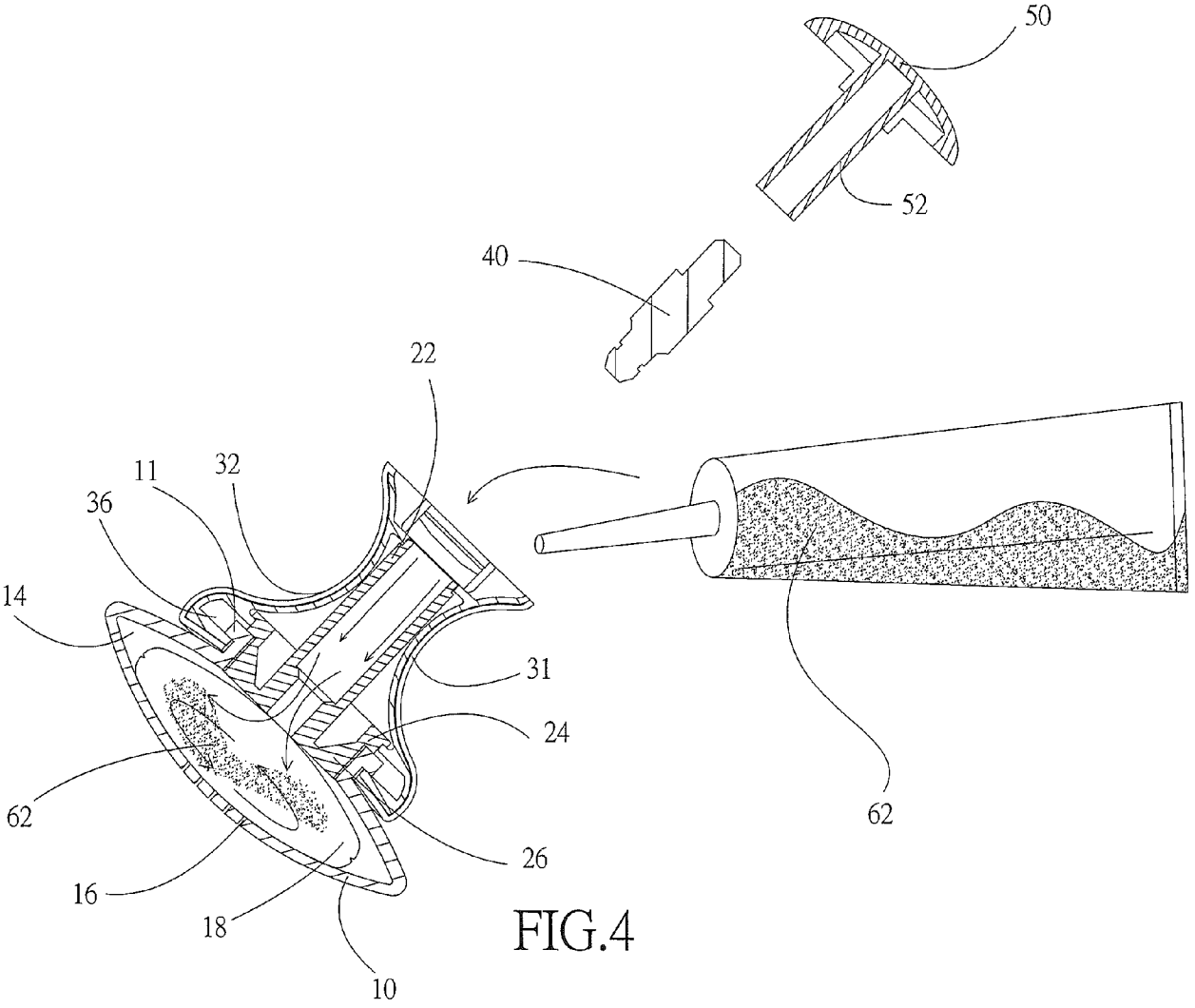
FIG. 4 schematically depicts a content filling operation of the cosmetic applicator.

As shown in FIGS. 2 and 4 specifically, after the first and second half housing 31 and 32, the central shaft seat 20, and the dispensing member 10 are assembled, in a filling operation an individual may squeeze a flexible cosmetic container (not numbered) to dispense contents (e.g., lotion) 62 of the cosmetic container into the space 14 to be absorbed by the sponge 18 via the channel 221 and the opening 12. The lotion 62 may permeate in the sponge 18. After the filling, the individual may install the check valve 40 in the channel 221 to block the cylinder 22 with the lower end 401 disposed in the smaller lower end of the channel 221 and being in close proximity to the sponge 18. Finally, the individual may close the top of the cosmetic applicator by disposing the cap 50 onto the first and second half housing 31 and 32 with the hollow stem 52 partially inserted into the channel 201 to dispose between the cylinder 22 and the extension 402, thereby causing the hollow stem 52 and the check valve 40 to block the channel 201, i.e., closing the cosmetic applicator.

It is noted that the dispensing member 10 is made of thermoplastic material or the like. Thus, the dispensing member 10 is flexible in nature. In use, the individual may hold the curved portions of the first and second half housing 31 and 32 and repeatedly press the surface of the dispensing member 10 having the perforations 16 onto the body of the individual to squeeze the lotion 62 out of the sponge 18. Finally, the lotion 62 flows through the perforations 16 to apply to the body of the individual to be rubbed.

Figure 5:
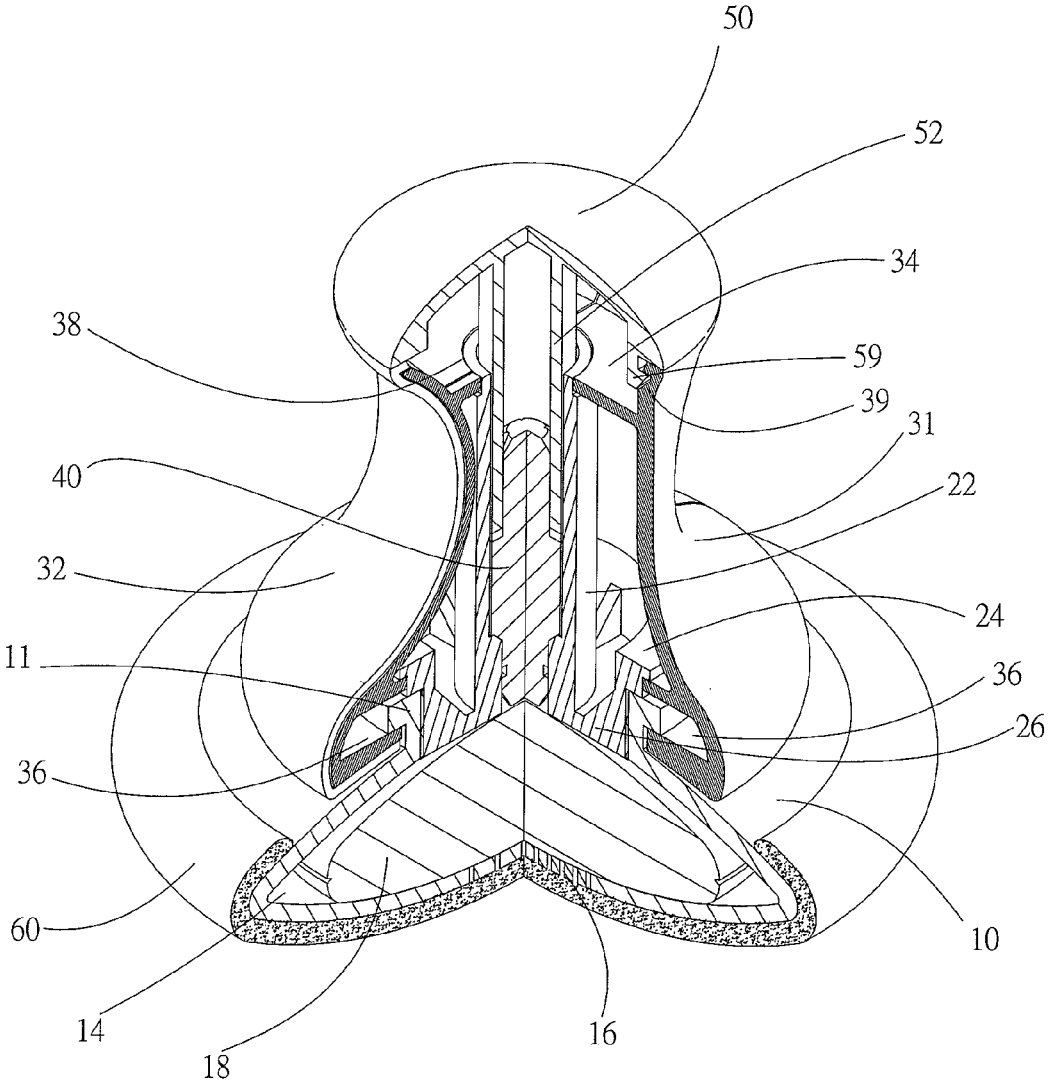
FIG. 5 is a partially broken away view of the cosmetic applicator.

As shown in FIGS. 4 and 5 specifically, a flexible cover 60 is put on the dispensing member 10 to enclose the dispensing member 10 including the perforations 16. Thus, the lotion 62 can be uniformly spread out through the perforations 16. The flexible cover 60 is usually made of powder puff.

While the invention has been described in terms of preferred embodiments, those skilled in the art will recognize that the invention can be practiced with modifications within the spirit and scope of the appended claims.

What is claimed is:

1. A cosmetic applicator comprising:

a dispensing member including a space, a plurality of perforations on a first surface, an opening on a second surface communicating with the space, the second surface being opposite to the first surface, and an externally extending rim formed around the opening;

a sponge disposed in the space;

a central shaft seat including an annular base disposed in the opening, an annular lip formed on the base and supported by the rim, and a hollow cylinder spaced from the lip, the cylinder having an axial channel extending from a first end to a second end adjacent to the base;

a first half housing including a curved trough adjacent to a bottom;

a second half housing including a curved trough adjacent to a bottom wherein the lip is fastened in the troughs of the first and second half housings, the first and second half housings complementarily secured together, and the central shaft seat is fastened in the first and second half housings;

a check valve including an extension disposed in the channel; and a cap including a hollow stem fastened on the extension of the check valve, the hollow stem partially disposed in the channel.

2. The cosmetic applicator of claim 1, wherein the first half housing further comprises a positioning member formed on an inner surface and spaced from the trough, and a curved member on an edge of the positioning member; the second half housing further comprises a positioning member formed on an inner surface and spaced from the trough, and a curved member on an edge of the positioning member; the cylinder includes a neck on a top, the neck having an outer diameter less than that of the cylinder, the neck being fastened by the curved members; and the curved members are supported by the top of the cylinder.

3. The cosmetic applicator of claim 2, wherein the first half housing further comprises a protrusion above the positioning member; the second half housing further comprises a protrusion above the positioning member; and the cap further comprises an annular latch on a bottom edge, the latch being secured to the protrusions to fasten the cap and the first and second half housings together.

4. The cosmetic applicator of claim 1, wherein the check valve includes a smaller lower end disposed in a lower end of the channel and being in close proximity to the base.

5. The cosmetic applicator of claim 1, wherein the cylinder, the lip, and the base are formed integrally.

6. The cosmetic applicator of claim 1, further comprising a flexible cover configured to put on the dispensing member to enclose the dispensing member.

7. The cosmetic applicator of claim 1, wherein the first half housing further comprises two recesses along two opposite ends of a surface respectively, the second half housing further comprises two projections along two opposite ends of a surface respectively, and the projections are fitted in the recesses to fasten the first and second half housings together.

8. The cosmetic applicator of claim 1, wherein the first and second half housing are formed integrally.

9. The cosmetic applicator of claim 1, wherein the central shaft seat and the first and second half housing are formed integrally.

10. The cosmetic applicator of claim 1, wherein the check valve and the cap are formed integrally.

* * * * *